US006082773A

United States Patent [19]

Janesky

[11] Patent Number: 6,082,773

[45] Date of Patent: Jul. 4, 2000

[54] PRODUCT/SERVICE CONTRACTUAL PROPOSAL BOOKLET

[76] Inventor: Lawrence M. Janesky, 11 Fawn Meadow La., Huntington, Conn. 06484

[21] Appl. No.: 09/307,624

[22] Filed: May 7, 1999

[51] Int. Cl.[7] ..... B41M 5/22

[52] U.S. Cl. ..... 283/66.1; 283/60.1; 283/64.1; 283/66.2; 462/39; 462/54

[58] Field of Search ..... 283/60.1, 64.1, 283/66.1, 66.2; 462/39, 54

[56] References Cited

U.S. PATENT DOCUMENTS

| | | | |
|---|---|---|---|
| 482,047 | 9/1892 | Mortimer | 283/64.1 |
| 3,481,759 | 12/1969 | Ostlie | 117/36.2 |

*Primary Examiner*—Andrea L Pitts
*Assistant Examiner*—Mark T. Henderson
*Attorney, Agent, or Firm*—Perman & Green, LLP

[57] ABSTRACT

A product/installation service proposal booklet for use in estimating the cost of installing proposed systems including such products, for quick review and acceptance by a customer. The booklet comprising a cover sheet and a multi-sheet, pressure-duplicating proposal order form group including an original order form sheet and at least one duplicate customer copy order form sheet, which are bonded together along one side edge of each, the undersurface of the cover sheet facing the face of the original order form sheet when the booklet is opened, being a product menu sheet illustrating and identifying specific products, one or more of which are to be included within the proposed systems. The face of the contractual proposal original order form sheet, and of the duplicate copies, carry a list of the specific products corresponding to those illustrated and identified on the facing menu sheet, and associated areas for designating the number of those of such products included within the proposal. The original order form preferably also carries an area within which the contractor can write a description and/or sketch of the proposed system. The original order form also includes areas within which the contractor can write the estimated cost and the authorized bending signature, and areas within which the customer an sign and apply the date of acceptance after conveniently comparing the list of included products on the order sheet with the identification/illustration of such products present on the facing menu sheet.

4 Claims, 1 Drawing Sheet

PRODUCT/SERVICE CONTRACTUAL PROPOSAL BOOKLET

BACKGROUND OF THE INVENTION

1. Field of the Invention

The present invention relates to contractual proposal order form booklets covering products to be ordered by a customer and services to be performed by a contractor or installer in connection with the installation of a system incorporating products selected by the customer, such as a basement waterproofing system.

2. State of the Art

Conventional contractual proposal order forms are known, in the form of a plurality of duplicate pressure-duplicating sheets which are attached to each other along one edge and which identify a plurality of products, for selection and designation by the customer, a plurality of installation services to be performed by the installer, an area on which the installer draws an illustration of the system to be installed, and an area on which both the customer and the installer can sign their acceptance of the terms of the proposal, after which one of the duplicate order forms can be separated from the other as customer copy.

A major disadvantage with the known proposed order forms is caused by the customer's lack of familiarity with the exact products identified generically or by trademark names on the order forms, leading to misunderstandings with respect to the designation of the desired products, and/or delays while the installer shows the customer the available products, per se, or a plurality of product brochures which illustrate the available products, i.e., two or more sump pumps which differ in cost and function. Moreover, misunderstandings can continue since the product illustrations do not form a part of the contractual order form.

Thus, it is highly desirable to provide a contractual order form booklet which includes illustrations of the available products, corresponding to the list of available products identified in the duplicate contractual order form, as selected and accepted by the customer.

SUMMARY OF THE INVENTION

The present invention provides novel contractual product/installation service order form booklets having a product descriptive and illustrative menu sheet attached along a side edge thereof to a facing multi-page, pressure duplicating order form carrying a product list including at least the products illustrated on the facing menu page, and adjacent areas for indicating the quantity of each product to be included within the proposal. The order form preferably also includes an area within which a drawing of the proposed installation system is to be sketched, and preferably areas on which to indicate specific features of the installation and site. The order form also includes contractual proposal language, to be signed and cost estimated by the contractor, and acceptance language to be signed and dated by the customer. The multi-page order form comprises at least one customer copy, identical to the original order form, and pressure-duplicating means such as carbonless-copy means or carbon paper, so that all information written onto the original order form is automatically reproduced on the identical copy or copies to provide the customer with a duplicate copy of the executed contractual proposal.

The executed original contractual proposal remains attached to the product descriptive and illustrative menu sheet of the booklet to provide a clear, unambiguous illustration of the specific products designated and quantity of each to be installed within the sketched system for the agreed-upon price.

THE DRAWINGS

FIG. 1 is a plan view of a contractual product/installation service order form booklet according to an embodiment of the present invention, illustrated with the cover sheet opened to show the obverse face thereof, comprising the menu sheet, and the facing original order form sheet comprising the top sheet of a multi-page, pressure-duplicating order form group, the sheets of the booklet being attached to one another along a common edge of each.

FIG. 2 is a plan view of the obverse or reverse side 17 of each of the sheets of the order form group 14, including the original sheet 15 and the customer copy sheet 16, according to a preferred embodiment of the present invention.

DETAILED DESCRIPTION

Figure 1:
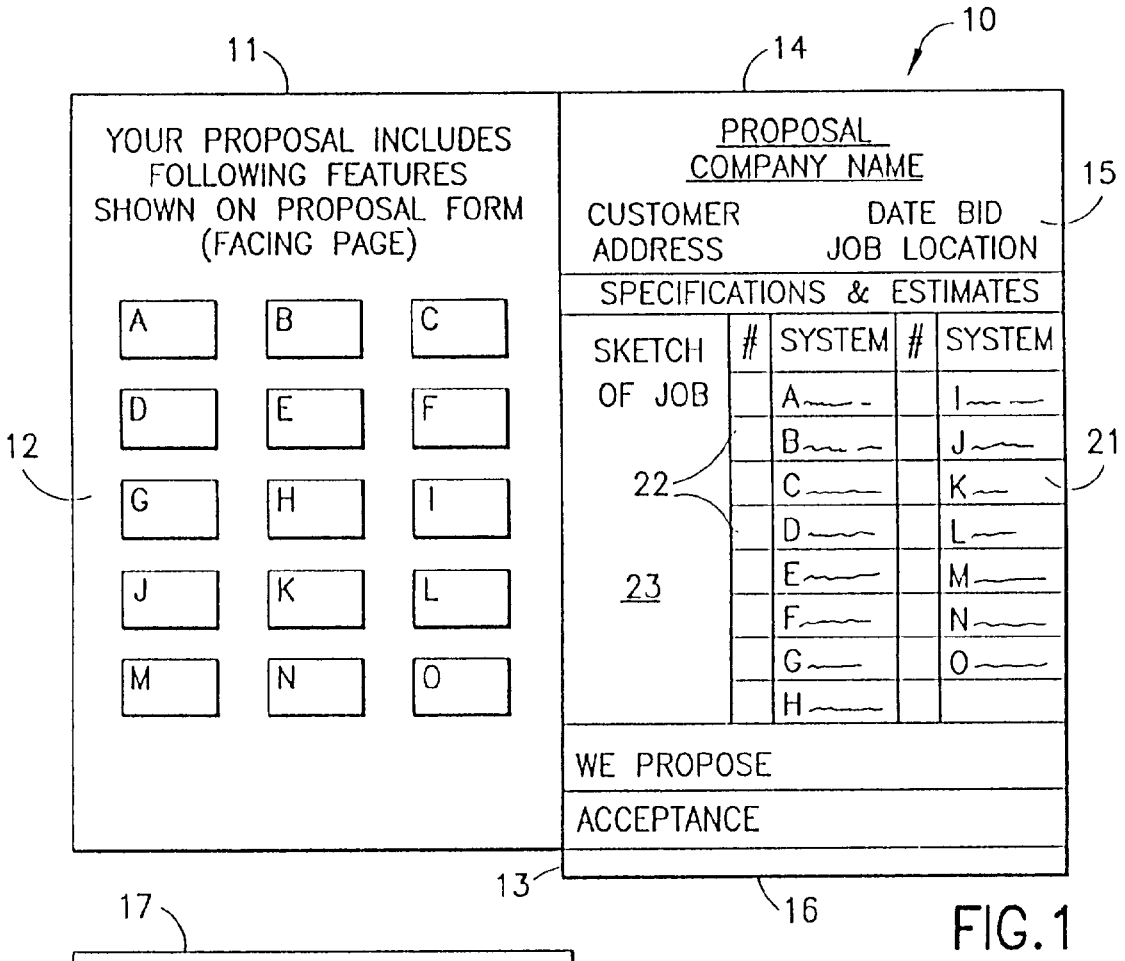

Referring to FIG. 1, the contractual product/installation service order form booklet 10 thereof comprises a cover sheet 11 forming on the obverse or undersurface thereof a product descriptive/illustrative menu sheet 12 attached along one side edge, such as by means of an adhesive bond 13, to a multi-page, pressure-duplicating order form group 14. The order form group comprises a plurality of substantially-identical order form sheets including at least a top original sheet 15 and at least one customer copy sheet 16, all bonded to one another and to the facing menu sheet 12 along a common side edge by means of the common adhesive bond 13.

While the order form group 14 can include interposed carbon paper sheets so that all information written onto the face of the original order form sheet 15 will be pressure-duplicated on the faces of all of the other identical order form sheets of the group 14, including the customer copy sheet 16, it is preferred to use an order form group of the "no-carbon-required" or conventional carbonless copy type for this duplicating purpose.

Figure 2:
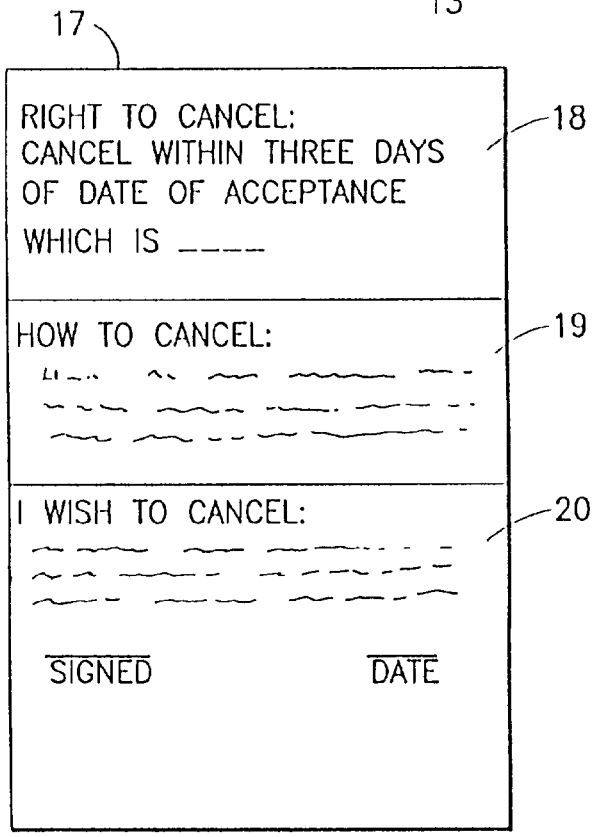

According to the preferred embodiment illustrated by FIG. 2 of the drawing the undersurfaces 17 of each of the order form sheets, including original 15 and the customer copies 16, are printed with a Notice of Right To Cancel including a description 18 advising of the customer's legal rights to cancel, such as within three days of the date of acceptance, a description 19 of How To Cancel, and an area 20 in which the customer can exercise the right to cancel by signing and dating the cancellation form and returning one of the duplicate executed customer copies 16 to the contractor within the required time period.

An essential feature of the present contractual product/installation service order form booklet 10 is the presence of the descriptive/illustrative menu sheet 12 attached to and facing the original order form sheet 15, and the presence on the order form sheets 15 and 16 of a trade name product list 21 corresponding to the products identified by their corresponding trade names, and illustrated, on the menu sheet 12, list 21 also including an area 22 adjacent each of the named products within which to designate and write the number of each of the desired products which are included within the system to be installed, as covered by the estimate. The menu sheet 12 preferably also includes a system-illustrating area 23 within which the contractor writes a description and/or sketch of the system to be installed, as covered by the estimate.

The essential novelty resides in the fact that the informative menu sheet 12 faces the original order form 15 and enables a quick and definite cross-reference between these sheets, both by the contractor who writes up the cost estimate and by the customer who reviews it before acceptance, or after installation when studying compliance. The close and fixed association of the face of the menu sheet with the face of the original order form avoids the need for the collection of various product brochures and data sheets relating to the various products for review and cross-reference by the contractor and the customer during preparation and acceptance of the proposal. Moreover, the specific illustrations or pictures and trade name (or trademark) identifications on the menu sheet assure the customer with specific rather than generic identifications of the products included within the cost estimate.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A product/installation service contractual proposal booklet for use by a contractor and a customer in estimating the cost of installing proposed systems including such products, for acceptance by said customer, comprising a cover sheet having an undersurface, and a multi-sheet, pressure-duplicating contractual proposal order form group including an original order form sheet having a face, and at least one duplicate customer copy order form sheet, said cover sheet and order form group being bonded together along one side edge of each, the undersurface of said cover sheet facing the face of the original order form sheet when the booklet is opened, and being a facing product menu sheet having an illustration/identification of a plurality of specific products, one or more of which are to be included within the proposed systems, and the face of the contractual proposal original order form sheet, and of the duplicate copies, carrying a list of the specific products corresponding to those in the illustration/identification on the facing menu sheet, and associated areas for designating a desired quantity of those of such products included within the proposal, the original order form also carrying areas within which the said contractor can write the estimated cost and apply his/her signature, and an area within which the said customer can sign and date as acceptance of the proposal after conveniently comparing the list of included products on the order sheet with the identification/illustration of such products present on the facing menu sheet.

2. A proposal booklet as defined in claim 1 in which the order form group also includes an area within which said contractor can write a description and/or sketch of the system covered by the proposal.

3. A proposal booklet as defined in claim 1 in which the pressure-duplicating order form group comprises carbonless copy paper sheets.

4. A proposal booklet as defined in claim 1 including at least two customer copy order form sheets having undersurfaces, in which said undersurfaces of such customer copy order form sheets are printed with a description of terms enabling the customer to cancel the acceptance of the proposal and areas within which to sign and date such cancellation, for return of one of the executed customer copy sheets to the contractor as notification of cancellation.

* * * * *